US011053042B2

(12) United States Patent
Plourde

(10) Patent No.: US 11,053,042 B2
(45) Date of Patent: Jul. 6, 2021

(54) CRUSHED END OF SELF-MATING CLOSURE SEGMENT FOR LAP OR FIN SEAL

(71) Applicant: Eric Plourde, Frankfort, IL (US)

(72) Inventor: Eric Plourde, Frankfort, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 285 days.

(21) Appl. No.: 15/776,986

(22) PCT Filed: Dec. 7, 2016

(86) PCT No.: PCT/US2016/065293

§ 371 (c)(1),
(2) Date: May 17, 2018

(87) PCT Pub. No.: WO2017/100263

PCT Pub. Date: Jun. 15, 2017

(65) Prior Publication Data

US 2018/0327128 A1 Nov. 15, 2018

Related U.S. Application Data

(60) Provisional application No. 62/264,545, filed on Dec. 8, 2015.

(51) Int. Cl.
*B65B 61/18* (2006.01)
*B65B 9/20* (2012.01)
(Continued)

(52) U.S. Cl.
CPC ..... *B65B 61/188* (2013.01); *B31B 70/644* (2017.08); *B31B 70/8133* (2017.08);
(Continued)

(58) Field of Classification Search
CPC ..... B65B 61/188; B65B 2220/08; B65B 2220/10; B31B 2155/001; B31B 2155/0014; B31B 2155/0012
(Continued)

(56) References Cited

U.S. PATENT DOCUMENTS 3,789,888 A * 2/1974 James ..... B65B 9/213 141/4
4,617,683 A * 10/1986 Christoff ..... B29C 65/20 383/35
(Continued)

FOREIGN PATENT DOCUMENTS

CN 1874932 12/2006
CN 101734405 6/2010
(Continued)

OTHER PUBLICATIONS

"Crush" definition. Merriam-Webster Online Dictionary. Retrieved from URL https://www.merriam-webster.com/dictionary/crush on Feb. 10, 2020 (Year: 2020).*
(Continued)

*Primary Examiner* — Valentin Neacsu
(74) *Attorney, Agent, or Firm* — McCarter & English, LLP

(57) ABSTRACT

This disclosure pertains to a forming device used in the formation of a package with a self-mating reclosure, where a single self-mating closure wraps around the periphery of the forming device, and one end of the zipper segment extends into the lap seal of the forming device. Alternatively, one or two ends of the zipper segment could extend into a fin seal. The self-mating reclosure is mounted transversely on the sheet of web or film and includes at least one crushed end proximate to one edge of the sheet of web or film. The self-mating closure may be pre-crushed, prior to attachment to the sheet of web or film, or may be crushed after the sheet
(Continued)

of web or film is wrapped around a forming device or similar structure.

23 Claims, 5 Drawing Sheets

(51) Int. Cl.
*B31B 70/64* (2017.01)
*B31B 70/81* (2017.01)
*B31B 155/00* (2017.01)

(52) U.S. Cl.
CPC ..... *B65B 9/20* (2013.01); *B31B 2155/0012* (2017.08); *B65B 2220/08* (2013.01); *B65B 2220/10* (2013.01)

(58) Field of Classification Search
USPC ..... 493/213, 214, 927, 929, 302; 53/133.4, 53/139.2, 450, 451, 455, 575; 383/63, 383/64, 61.2; 206/810, 468
See application file for complete search history.

(56) References Cited

U.S. PATENT DOCUMENTS 4,655,862 A * 4/1987 Christoff ..... B29C 65/20 156/244.11
4,709,398 A * 11/1987 Ausnit ..... B65D 33/002 156/66
4,909,017 A * 3/1990 McMahon ..... B65B 61/188 156/66
5,111,643 A * 5/1992 Hobock ..... B65B 9/20 53/139.2
5,412,924 A * 5/1995 Ausnit ..... B65B 9/20 53/133.4
5,557,907 A * 9/1996 Malin ..... B65B 9/20 53/139.2
5,816,018 A * 10/1998 Bois ..... B65B 9/20 53/133.4
5,972,396 A * 10/1999 Jurgovan ..... B65D 33/2533 426/106
6,216,423 B1 * 4/2001 Thieman ..... B65B 9/06 53/133.4
6,327,754 B1 * 12/2001 Belmont ..... B65B 9/093 24/389
6,360,513 B1 * 3/2002 Strand ..... B65D 33/2591 493/213
6,530,870 B2 * 3/2003 Buchman ..... B65B 9/20 493/114
6,588,176 B1 * 7/2003 Buchman ..... B31B 70/00 53/133.4
6,605,026 B1 * 8/2003 Tomic ..... B65D 33/2591 493/213
6,634,158 B1 * 10/2003 Bois ..... B65B 9/20 53/551
6,792,740 B2 * 9/2004 Buchman ..... B31B 70/00 493/213
7,093,409 B2 * 8/2006 Dutt ..... B65B 9/093 53/133.4
7,101,079 B2 * 9/2006 Strand ..... B65D 33/2591 383/104
7,159,282 B2 * 1/2007 Blythe ..... B65D 33/2591 24/400
8,690,046 B2 * 4/2014 Plourde ..... B65D 33/24 229/125.015
8,690,428 B2 * 4/2014 Kruse ..... B65D 33/2591 383/5
10,093,457 B2 * 10/2018 Steele ..... B65D 33/2508
2002/0077238 A1 * 6/2002 Buchman ..... B65B 9/20 493/394
2002/0139704 A1 * 10/2002 Buchman ..... B65B 9/20 206/459.1
2003/0050167 A1 * 3/2003 Kinigakis ..... B65B 9/20 493/394
2003/0172622 A1 * 9/2003 Kinigakis ..... B65B 61/188 53/412
2003/0208989 A1 * 11/2003 Thomas ..... B65B 9/20 53/412
2003/0228078 A1 * 12/2003 Clune ..... A44B 18/0084 383/93
2004/0083685 A1 * 5/2004 Knoerzer ..... B29C 66/232 53/412
2004/0166262 A1 * 8/2004 Busche ..... B65D 75/002 428/34.9
2006/0111226 A1 * 5/2006 Anzini ..... B65D 33/2508 493/214
2006/0210202 A1 * 9/2006 Plourde ..... B65B 9/20 383/63
2008/0047228 A1 * 2/2008 Anzini ..... B65D 33/2591 53/412
2010/0142858 A1 * 6/2010 Kruse ..... B65D 75/5866 383/5
2011/0266336 A1 * 11/2011 Plourde ..... B65D 33/24 229/247
2012/0202667 A1 * 8/2012 Greco ..... B65D 33/20 493/210
2014/0069061 A1 * 3/2014 Anzini ..... B65B 11/004 53/450

FOREIGN PATENT DOCUMENTS

CN 102596726 7/2012
CN 204473206 7/2015
WO 2011137048 11/2011
WO 2015130851 9/2015

OTHER PUBLICATIONS

International Search Report for PCT/US2016/065293 dated May 4, 2017.

* cited by examiner

CRUSHED END OF SELF-MATING CLOSURE SEGMENT FOR LAP OR FIN SEAL

This application is a national phase of application no. PCT/US2016/065293 filed on Dec. 7, 2016 which claims priority under 35 U.S.C. 119(e) of U.S. provisional application Ser. No. 62/264,545, filed on Dec. 8, 2015, the contents of which is hereby incorporated by reference in its entirety and for all purposes.

BACKGROUND OF THE DISCLOSURE

Field of the Disclosure

This disclosure pertains to a tube used in the formation of a package with a self-mating closure, where a single self-mating closure wraps around the periphery of the tube, and one end of the zipper segment extends into the lap seal of the tube. Alternatively, one or two ends of the zipper segment could extend into a fin seal.

Description of the Prior Art

Current packages with a self-mating closure (such as the Zip360 by Illinois Tool Works Inc.) made with a lap or fin seal typically are produced by not extending one, or both, edges of the closure segment all the way across the width of the film in order to keep the closure out of the lap seal. Keeping the closure out of the lap seal allows for a hermetic seal along the entire height of the package. However, while this is well-suited to its intended purpose, this may result in a gap between the ends of the closure segment at the lap or fin seal. This gap can be obvious to the consumer, who will be concerned about the integrity of the reclosed package.

OBJECTS AND SUMMARY OF THE DISCLOSURE

It is therefore an object of the present disclosure, in a tube for the formation of a package with a self-mating zipper, to substantially eliminate or reduce the gap between the ends of a closure segment at the lap or fin seal.

These and other objects are attained by crushing the end(s) of the zipper segment, either prior to forming the tube (for example, with a continuous web with transversely applied segments of disclosure, such as, but not limited to, an InnoLok® machine), or crushing it on the fill tube after forming the film into the tube and prior to completing the lap or fin seal, the closure can be made to run around the entire periphery of the tube and still allow the lap sealing apparatus to create a hermetic seal due to the reduced thickness of the closure in the lap or fin seal area.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
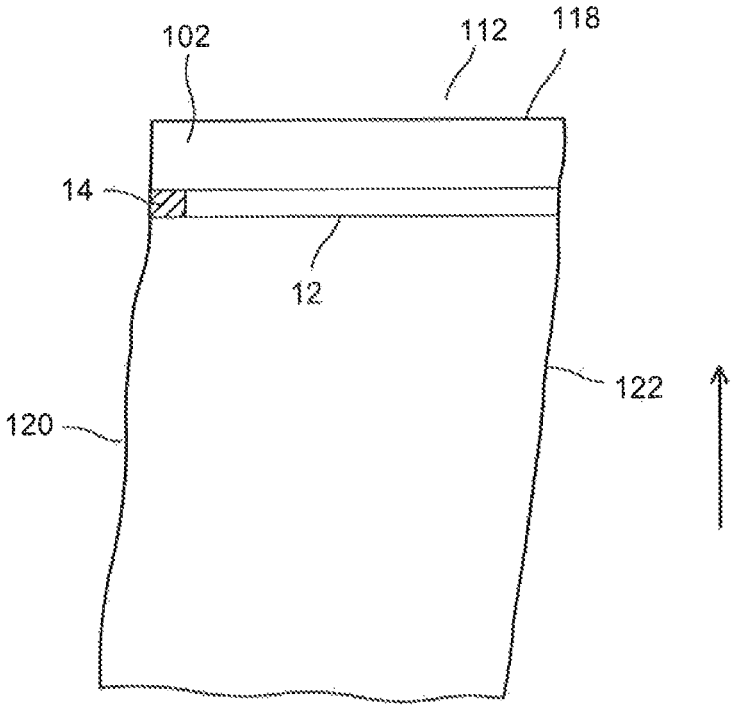
FIG. 1 is a plan view of a first embodiment flat sheet of web or film of the present disclosure, shown with the closure, reclosure or zipper attached to the film in the transverse direction and a crushed area.

Referring now to the drawings in detail wherein like numerals refer to like elements, one sees that FIG. 1 illustrates a flat sheet of polymeric web or film 102 with edges 120, 122. This is intended to illustrate a continuous sheet of web, running in the illustrated vertical direction, line 118 is illustrated for the purpose of illustrating the intended upper edge of the package, formed by cutting the tube 10 illustrated in FIG. 2. A self-mating reclosure, closure or zipper 12 is sealed or otherwise attached to sheet 102, in a transverse direction, downwardly adjacent from line 118. A crushed portion 14 is formed by crushing the reclosure, closure or zipper 12, immediately inwardly adjacent from edge 120.

Figure 2:
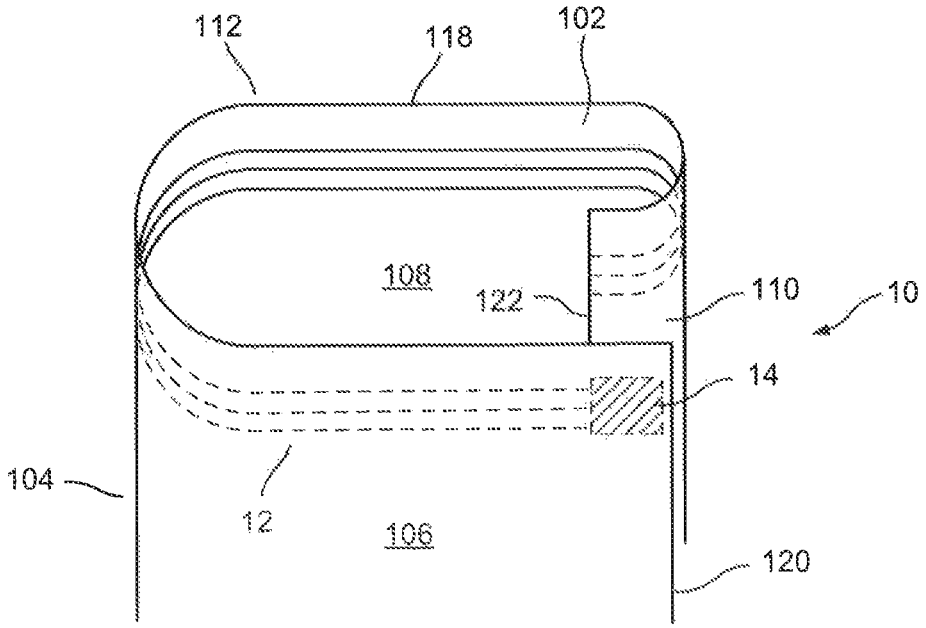
FIG. 2 is a partially exploded view of the tube of the present disclosure, made from the sheet illustrated in FIG. 1.

To form the tube 10 of FIG. 2, the sheet 102 of FIG. 1 is folded so as to form fold 104 and further defining front wall 106 and rear wall 108 from sheet 102. The edge 120 is laid on or over the edge 122 so that the crushed portion 14 of reclosure, closure or zipper 12 is adjacent to edge 102. Side seal 110 is then formed as a lap seal with the crushed portion 14 of reclosure, closure or zipper 12 between front and rear walls 106, 108. In the embodiment of FIGS. 1 and 2, the self-mating closure, reclosure or zipper 12 extends around the entire width of sheet 102 and the crushed portion 14 helps the consumer feel the reclosed package is more secure. There is essentially no gap from the end of the closure segment to the edges 120, 122 of the web 102.

Figure 3:
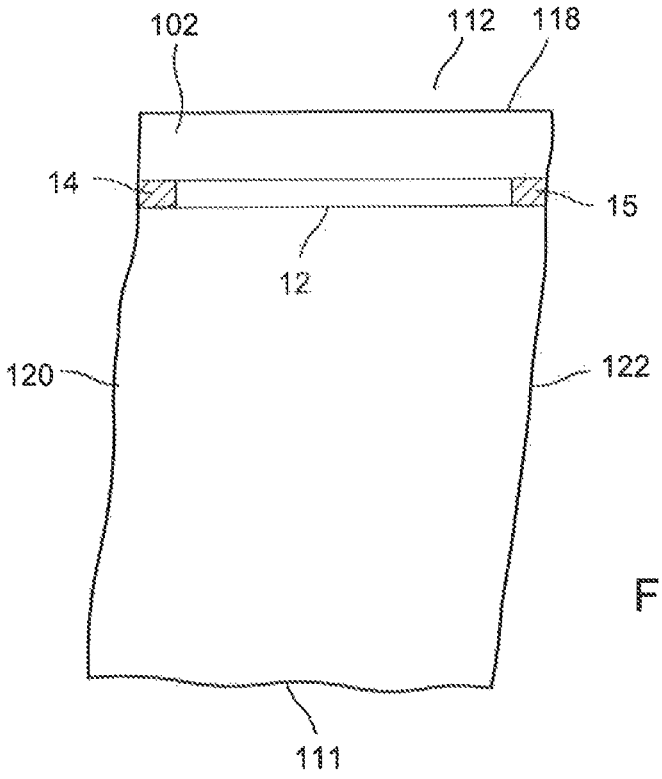
FIG. 3 is a plan view of a second embodiment flat sheet of web or film of the present disclosure, shown with the closure, reclosure or zipper attached to the film in the transverse direction and two crushed areas.

FIG. 3 is similar to FIG. 1, except that a second crushed area 15 has been added to reclosure, closure or zipper 12, immediately adjacent to edge 122 of sheet 102.

Figure 4:
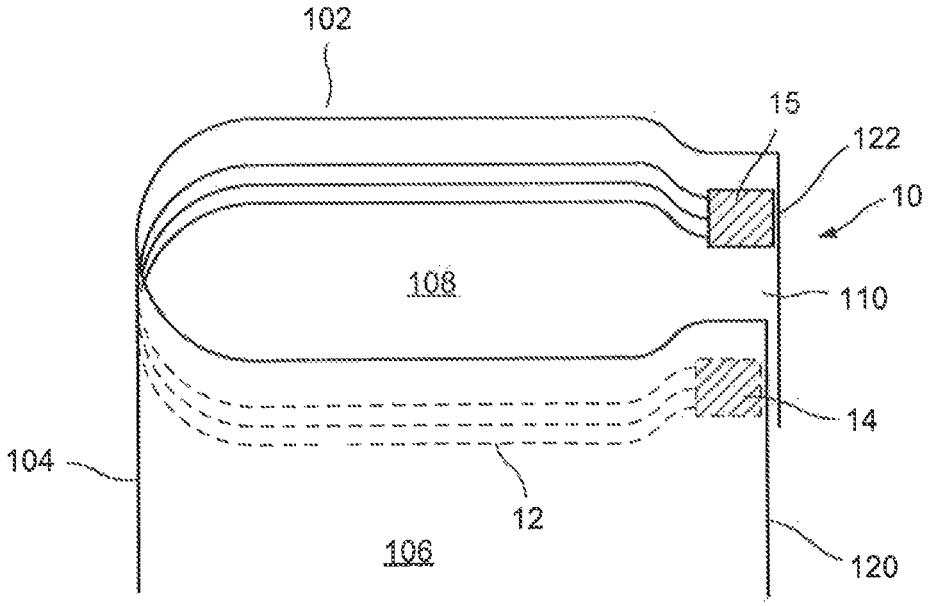
FIG. 4 is a partially exploded view of the tube of the present disclosure, made from the sheet illustrated in FIG. 3.

To form the tube 10 of FIG. 4, edges 120, 122 of the sheet 102 of FIG. 3 are brought together by wrapping sheet 102 around a forming tube (see FIGS. 7A and 7B), thereby forming fold 104, so that crushed areas 14, 15 overlay or are pressed against each other. Seal 110 is then formed as a fin seal with crushed areas 14, 15 between front and rear sheets 106, 108.

When formed into a tube 10, the crushed end portions 14, 15 of the closure, reclosure or zipper 12 extend into the fin seal 110, but due to their reduced height, a hermetic seal can be achieved. The typically less preferred alternative would be to place a length of closure, reclosure or zipper 12 on the web 102 with gaps 124 at both ends of closure, reclosure or zipper 12. That is, the ends of zipper 12 terminate inwardly adjacent from first and second edges 120, 122 so that the ends of the closure, reclosure or zipper 12 precisely match up at the fin seal. However, in manufacturing practice, it would be expected that the ends of the closure, reclosure or zipper 12 would either extend into the fin seal 110, and possibly interfere with the formation of a hermetic seal, or there will be a gap between the ends of the closure, reclosure or zipper 12 and the fin seal 110, of which the consumer would likely disapprove.

Figure 5:
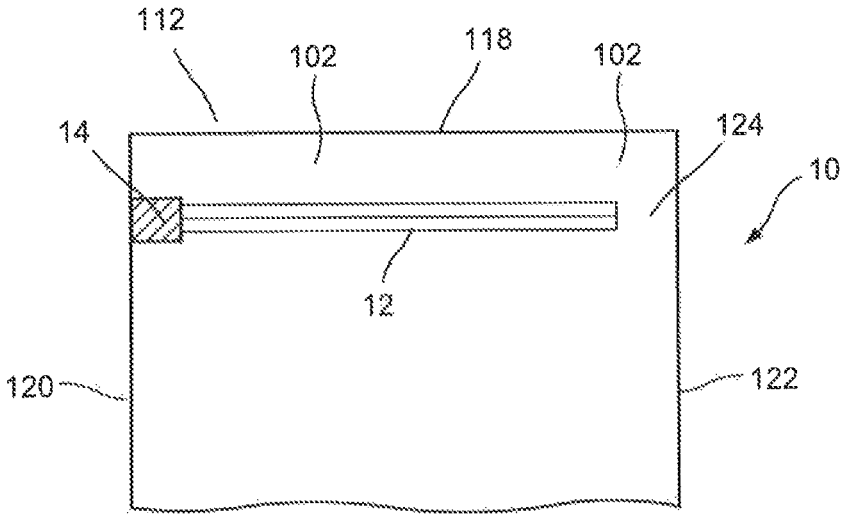
FIG. 5 is a plan view of a third embodiment flat sheet of web or film of the present disclosure, shown with the closure, reclosure or zipper attached to the film in the transverse direction, not extending to the edge of the web or film, and a crushed area.

FIG. 5 is similar to FIG. 1, except that the illustrated right end of the reclosure, closure or zipper 12 terminates inwardly adjacent from edge 122 of sheet 102, thereby leaving a gap 124 between the reclosure, closure or zipper 12 and edge 122 of sheet 102.

Figure 6:
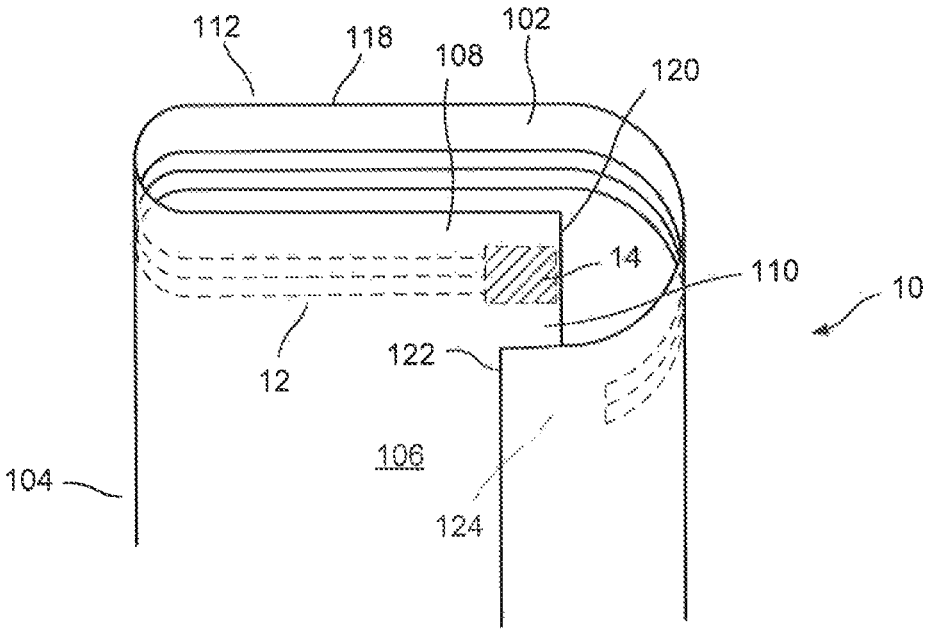
FIG. 6 is a partially exploded view of the tube of the present disclosure, made from the sheet illustrated in FIG. 5.

To form the tube 10 of FIG. 6, edges 120, 122 are brought together by wrapping sheet 102 around a forming tube (see FIGS. 7A and 7B), thereby forming fold 104 and further defining front wall 106 and rear wall 108 from sheet 102, so that gap 124 is overlaid or placed over edge 120 and seal 110 is formed as a lap seal, with the crushed area 14 on the interior of the tube 10, rather than within the lap seal 110. Some embodiments of FIGS. 5 and 6 may form a fin seal 110 between gap 124 and crushed area 14.

As seen from FIGS. 2, 4 and 6, a self-mating closure, reclosure or zipper 12 extends around the periphery of the tube 10, downwardly adjacent from line 118 which indicates wherein the tube 10 will be subsequently cut in order to form the top edge of the subsequently formed package 11.

Similarly, a fin seal can be made where crushed end portion(s) 14 (and 15) of the closure, reclosure or zipper 12 extend into the fin seal and the reduced thickness of the crushed end portion(s) 14 (and 15) will allow a hermetic fin seal to made without trying to align or stop the ends of the closure, reclosure or zipper 12 exactly where the fin seal starts. The crushing of the end portion(s) can be done on the InnoLok® machine, or on the fill tube of a form, fill seal machine just prior to making the fin seal.

Figure 7A:
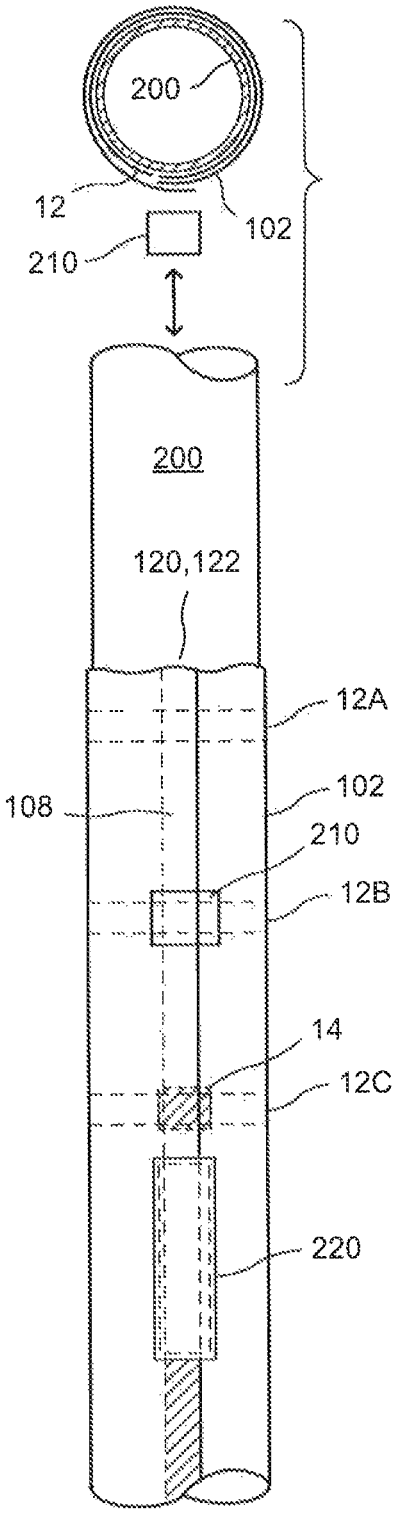
FIG. 7A is a schematic of a form fill seal machine producing embodiments of the tubes of the present disclosure with a lap seal.
Figure 7B:
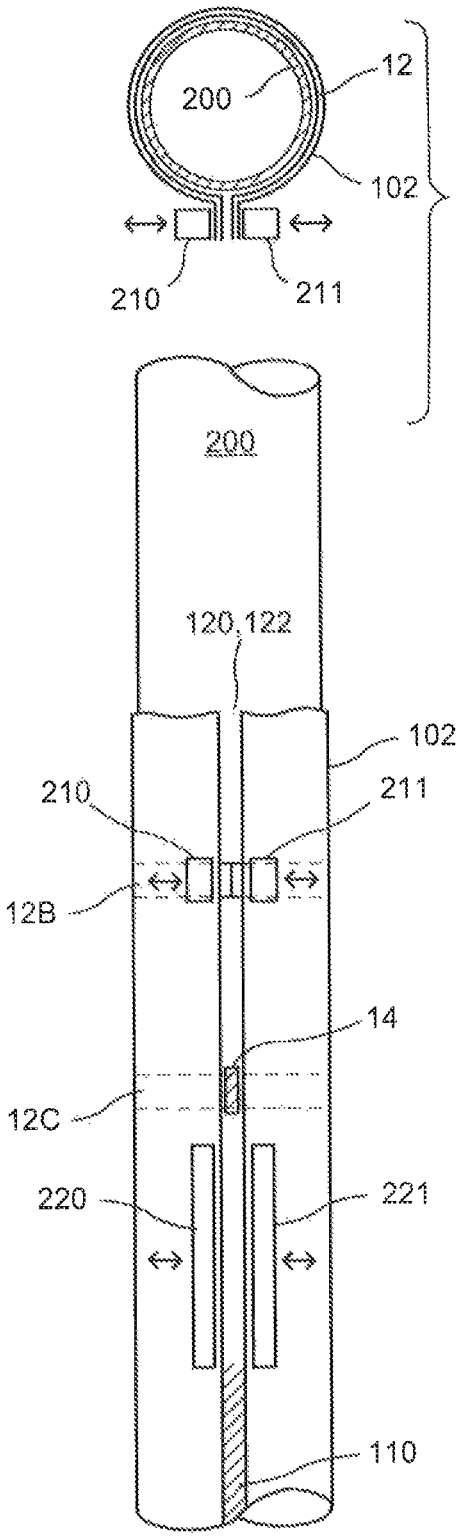
FIG. 7B is a schematic of a form fill seal machine producing embodiments of the tubes of the present disclosure with a fin seal.
Figure 8:
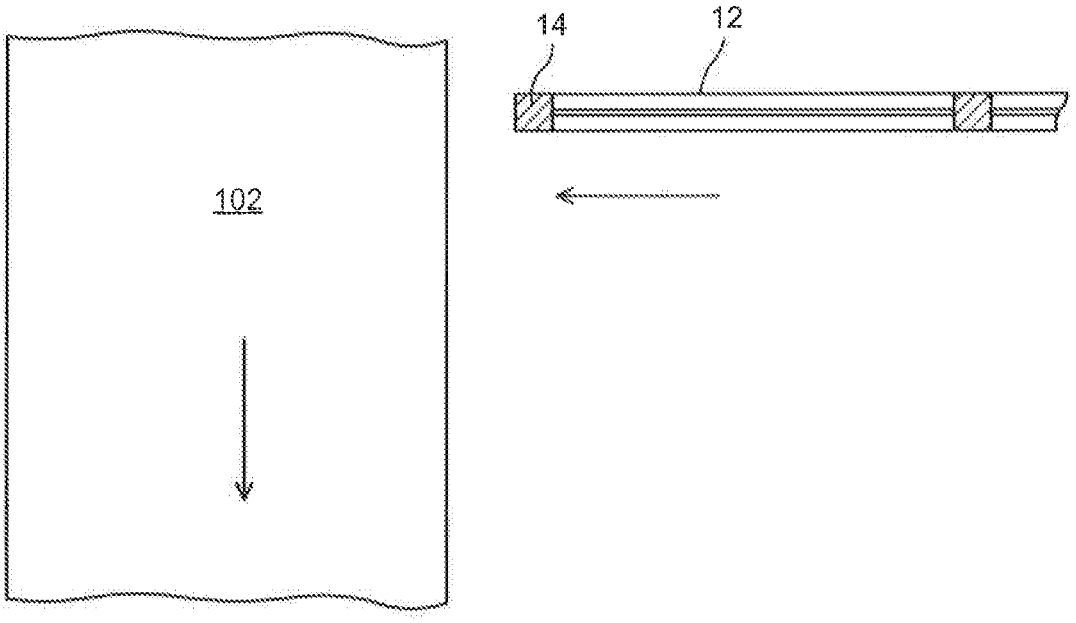
FIG. 8 is a schematic of a segment of the pre-crushed reclosure, closure or zipper being provided transversely to a sheet of web moving in the machine direction.

The embodiments of FIGS. 1, 3 and 5 show how the segment of closure, reclosure or zipper 12 could be pre-crushed and then applied in the transverse direction to the web on an InnoLok® machine (see FIG. 8). Alternately, the pre-crushing could be done after the segment of closure, reclosure or zipper 12 is applied to web 102. The methods of FIGS. 7A and 7B show the crushing of the closure, reclosure or zipper 12 after the web 102 has been wrapped around a forming tube 200. In the embodiment of FIGS. 5 and 6, the self-mating closure, reclosure or zipper 12 is applied so that there is a gap 124 between one end of the closure, reclosure or zipper 12 and second side edge 122 of the web 102. The other end of the self-mating closure, reclosure or zipper 12 is crushed thereby forming crushed portion 14. When the film or web 102 is formed into a tube, the gap 124 on second side edge 122 of web 102 overlaps the first side edge 120 and the crushed portion 14 of the self-mating closure, reclosure or zipper 12 thereby allowing the lap seal apparatus to make a hermetic seal due to the reduced height of the self-mating closure, reclosure or zipper 12 in this area, while there is still the appearance of the closure, reclosure or zipper 12 extending across the entire width of the rear wall 104 of the bag 10.

FIG. 7A illustrates a forming tube 200 of a form fill and seal device, as may be used to manufacture the tubes 10, with a lap seal, of the present disclosure. The sheet of web 102 is wrapped around the forming tube 200 so as to overlap the edges 120, 122 of the sheet of web 102 in order to position the edges for the subsequent formation of the lap or fin seal 110. The reclosure, closure or zipper 12 is positioned on the interior of sheet of web 102, between the forming tube 200 and the sheet of web 102 (see cross-sectional view in upper portion of FIG. 7A). The sheet of web 102 progresses downwardly along forming tube 200 as is known in the prior art. The reclosure, closure or zipper illustrated at 12A is typically uncrushed. However, the crusher 210 (see cross-sectional view in upper portion of FIG. 7A) operates on the reclosure, closure, or zipper at 12B to form the crushed area 14 as illustrated at 12C. Thereafter, seal bar(s) 220 operate to create the lap seal 110.

FIG. 7B illustrates a forming tube 200 of a form fill and seal device, as may be used to manufacture tubes 10, with a fin seal, of the present disclosure. This figure is similar to FIG. 7B, but crushers 210, 211 are configured to oppose each other, to engage the reclosure, closure or zipper 12 and sheet of web 102 in a fin seal type configuration at position 12B. Likewise, opposed seal bars 220, 221 operate to create the fin seal 110.

As illustrated in FIG. 8, reclosure, closure or zipper 12 can be provided with a pre-formed crushed area 14 and provided transversely to the machine direction of sheet of web 102 upstream or prior to the forming tube 200 of FIGS. 7A, 7B.

Typically, a benefit of this disclosure is that the closure can extend into the fin or lap seal, providing a closure around the entire periphery of the bag mouth (even if a portion is crushed) and still achieve a hermetic lap/fin seal. It eliminates the need to attempt to precisely control the length and position of the closure segment as it is applied to the web. The crushing can be performed during the pre-applying of the closure segment, or, especially for form fill seal processes, on the fill tube, or at any point upstream from the fill tube.

Thus the several aforementioned objects and advantages are most effectively attained. Although preferred embodiments of the invention have been disclosed and described in detail herein, it should be understood that this invention is in no sense limited thereby.

What is claimed is:

1. A method for production of a package or bag, including the steps of:

providing a sheet of web or film in a machine direction;

placing a reclosure segment on the sheet of web or film in a transverse direction perpendicular to the machine direction, the reclosure segment having opposed first end second ends separated by a central area, the first end, second end, and central area having a same initial thickness as measured in a thickness direction perpendicular to the machine direction and to the transverse direction;

after the placing step, wrapping the sheet of web or film around a forming device, thereby bringing together first and second edges of the sheet of web or film;

after the wrapping step, crushing at least one of the first and second ends of the reclosure segment thereby forming a first crushed area of reduced thickness as compared to the initial thickness, the central area maintaining the initial thickness unchanged during and after the crushing step; and after the crushing step, sealing the first and second edges of the sheet of web or film to each other.

2. The method of claim 1 wherein the reclosure segment is a self-mating reclosure.

3. The method of claim 2 wherein the sheet of web or film is polymeric.

4. The method of claim 3 wherein the step of crushing the step of crushing is performed while the sheet of web or film is wrapped around the forming device.

5. The method of claim 2 wherein the first end of the reclosure segment extends to the first edge of the sheet of web or film and the second end of the reclosure segment extends to the second edge of the web or film.

6. The method of claim 5 further including the step of crushing the second end of the reclosure segment thereby forming a second crushed area.

7. The method of claim 6 wherein bringing together the first and second edges of the sheet of web or film further includes the step of bringing together the first and second crushed areas.

8. The method of claim 7 wherein the step of sealing the first and second edges of the sheet to each other further includes the step of sealing the first and second crushed areas to each other.

9. The method of claim 8 wherein the step of sealing the first and second crushed areas to each other further includes the step of forming a fin seal.

10. The method of claim 2 wherein the second end of the reclosure segment is separated from the second edge of the sheet of web or film thereby forming a gap adjacent to the second edge of the sheet of the web or film.

11. The method of claim 10 wherein bringing together first and second edges of the sheet of web or film includes the step of placing the gap adjacent to the second edge of the sheet of the web or film over the first edge of the sheet of the web or film, on a face opposite from the first crushed area.

12. The method of claim 11 wherein the step of sealing includes the step of forming a lap seal.

13. A method for production of a package or bag, including the steps of:

providing a sheet of web or film in a machine direction;

placing a reclosure segment on the sheet of web or film in a transverse direction perpendicular to the machine direction, the reclosure segment having opposed first end second ends separated by a central area, at least one of the first and the second ends having a first crushed area, the first crushed area having a reduced thickness compared to a thickness of the central area as measured in a thickness direction perpendicular to the machine direction and to the transverse direction;

after the placing step, wrapping the sheet of web or film around a forming device, thereby bringing together first and second edges of the sheet of web or film; and after the placing step and the wrapping step, sealing the first and second edges of the sheet of web or film to each other.

14. The method of claim 13 wherein the reclosure segment is a self-mating reclosure.

15. The method of claim 14 wherein the sheet of web or film is polymeric.

16. The method of claim 14 wherein the first end of the reclosure segment extends to the first edge of the sheet of web or film and the second end of the reclosure segment extends to the second edge of the web or film.

17. The method of claim 16 wherein the reclosure segment includes a second end with a second crushed area.

18. The method of claim 17 wherein bringing together the first and second edges of the sheet of web or film further includes the step of bringing together the first and second crushed areas.

19. The method of claim 18 wherein the step of sealing the first and second edges of the sheet together further includes the step of sealing the first and second crushed areas to each other.

20. The method of claim 19 wherein the step of sealing the first and second crushed areas together further includes the step of forming a fin seal.

21. The method of claim 14 wherein a second end of the reclosure segment is separated from the second edge of the sheet of web or film thereby forming a gap adjacent to the second edge of the sheet of the web or film.

22. The method of claim 21 wherein bringing together first and second edges of the sheet of web or film includes the step of placing the gap adjacent to the second edge of the sheet of the web or film over the first edge of the sheet of the web or film, on a face opposite from the first crushed area.

23. The method of claim 22 wherein the step of sealing includes the step of forming a lap seal.

* * * * *